United States Patent [19]

Wakabayashi

[11] 4,029,173

[45] June 14, 1977

[54] FOLDABLE SCAFFOLD DEVICES

[76] Inventor: Hidenori Wakabayashi, 41-227, Ohtakacho, Chiba, Japan

[22] Filed: Dec. 23, 1975

[21] Appl. No.: 643,818

[30] Foreign Application Priority Data

Dec. 30, 1974 Japan ..... 49-2582
Dec. 30, 1974 Japan ..... 49-2583

[52] U.S. Cl. ..... 182/150; 182/55; 182/152

[51] Int. Cl.[2] ..... A47L 3/02; E04G 3/08

[58] Field of Search ..... 182/150, 132, 53–62, 182/95, 152; 211/201, 149

[56] References Cited

UNITED STATES PATENTS

| | | | |
|---|---|---|---|
| 621,404 | 3/1899 | Gailey | 182/150 |
| 1,128,212 | 2/1915 | Woolard | 182/95 |
| 1,142,596 | 6/1915 | Mangisch | 182/56 |
| 1,272,173 | 7/1918 | Acvin | 182/55 |
| 1,295,453 | 2/1919 | Edland | 182/55 |
| 2,184,457 | 12/1939 | Kruse | 182/59 |
| 2,849,257 | 8/1958 | Woyton | 182/55 |
| 2,854,292 | 9/1958 | Schaeffer | 182/150 |
| 3,124,213 | 3/1964 | Jorsey | 182/150 |

*Primary Examiner*—Reinaldo P. Machado

*Attorney, Agent, or Firm*—McGlew and Tuttle

[57] ABSTRACT

An erectable and transportable scaffold cage adapted to be engaged on and supported on a support beam comprises front and rear frame structures which are pivotally interconnected by means of parallel side braces which are connected between the frame structures. A reinforcing frame is pivotally connected to the lower ends of each of the front and rear frames and the front frame is pivotal outwardly from the rear structure to form a cage within the front and rear structures and the side braces having a floor formed by a scaffold plate which is supported on the reinforcing frame. The plate has upright bottom edges which fit flush against the insides of an angle member forming the sides of the front frame structure so that it facilitates the holding of the structure in an erected cage forming position. A flexible member such as a chain is connected between the upper ends of each side of the front structure to the upper ends of each side of the rear structure. The rear structure also carries a bolt having a pawl which is slidable therealong and which may be engaged against a support structure such as an I-beam by threading a wing nut onto the bolt behind the pawl to lock it in position.

4 Claims, 3 Drawing Figures

FOLDABLE SCAFFOLD DEVICES

BACKGROUND OF THE INVENTION

1. FIELD OF THE INVENTION

This invention relates in general to the construction of scaffolding devices and in particular to a new and useful scaffold which includes front and rear spring structures which are pivotally interconnected by parallel side braces so that the front stucture may be suspended by means of a flexible element outwardly from the rear structure to form a cage.

2. DESCRIPTION OF THE PRIOR ART

The invention relates to the construction of foldable scaffold devices which are particularly useful in the erection of buildings or the construction of ships, etc. The known structures which are used for such purposes comprise permanent devices which are assembled directly to the building site and which are affixed or suspended at the site by expensive and separate supporting structures. A disadvantage of the known structures is that they are difficult to adapt to each type of construction and to position n place to construct such that they have the necessary hand rails and fittings for accomodating workers at the site.

SUMMARY OF THE INVENTION

In accordance with the present invention there is provided an erectable and transportable scaffold cage which includes a rear frame which is pivoted to front frame by means of a plurality of vertically spaced parallel side braces. The side braces permit the pivotal support of the front structure either in juxtaposition to the rear struture or at a location extending outwardly therefrom at which the braces extend horizontally and form hand rails. The lower ends of the front and rear structures are interconnected by a reinforcing plate which may be pivoted along with the structure to collapse the front structure against the rear structure or to erect it in an outward position. In the erected position a floor plate inserted over the reinforcing plate helps sustain the structure in an erected position along with suspending elements in the form of chains which extend from the upper ends of the flat structure to the upper ends of the rear structure at each side.

Accordingly, it is an object of the invention to provide an erectable and transportable scaffold cage which includes a front frame member which is pivotally connected to a rear frame member and which may be folded into juxaposition therewith for transportation or spaced outwardly therefrom to form a cage and which includes means for securing the entire element in position on a supporting structure such as a beam.

A further object of the invention is to provide an erectable and transportable scaffold cage which is simple in design, rugged in construction and economical to manufacture.

DETAILED EXPLANATION OF THE INVENTION

Figure 3:
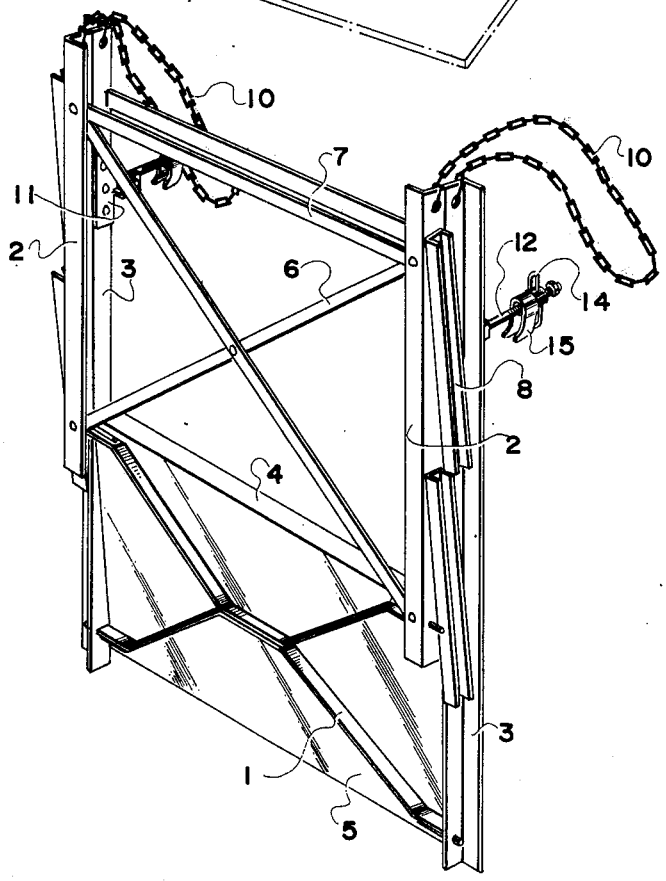
FIG. 3 is a perspective view of the scaffold device in FIG. 1 as folded.

In accordance with the invention there is provided an erectable and transportable scaffold cage which comprises a rear frame structure may up of elongated side struts 3, 3 which are interconnected by a plurality of horizontal transversely extending brace beams 9. A front frame structure comprising side angled members 2, 2 which are shorter than the rear angled 3, 3 and one or more cross members 7 and diagonal bracing 6 is hinged to the rear structure through a plurality of parallel lateral bracing members or supports 8 which are articulated at their respective ends to the respective front and rear structures. The front structure may be folded into juxaposition with the rear structure as shown in FIG. 3 or it may be erected to the positiin in FIG. 1 in which the reinforcing plate 1 extends substantially horizontally. The reinforcing plate 1 is provided with a plurality of bolt portions which are pivotally connected to the respective struts 2, 2 and 3, 3 at their lower ends. The scaffold plate 5 inserted over the reinforcing plate 1 includes upstanding side edges 4 which engage within the angled members 2, 2 in the erected position but do not hinder the folding of the structure. The upper ends of each of each of these front frame sides 2, 2 are connected to the upper ends of the rear struts 3, 3 by flexible elements such as chains 10.

The rear structure contains means for supporting the structure on a support structure such as an I-beam 16 which includes a holding bracket 11 to which is pivotally connected a bolt member 12. The pawl 13 having a cylindrical portion 15 is engaged over the bolt 12 and the pawl may be urged against the underside of an I-beam top flange by tightening a nut 14 which is engageable on the threads of the bolt 12.

Anglebars form short front struts 2 and long rear struts 3. The lower ends of the short struts 2 and the long struts 3 are rotatably supported on pivot pin 1a carried on respective corners of a substantially X-shaped reinforcing frame 1. A scaffold plate 5 having an upright skirt 4 extending around its periphery is placed on the reinforcing frame and is supported thereby and also by bolts 1a in the four corners.

An X-shaped bracing on beam 6 and a horizontal plate 7 are rotatably supported at their ends respectively on respective opposite ends of the front struts 2 so as to form both a reinforcement and a handrail.

The front struts 2 and rear struts 3 are rotably connected with one another through a plurality of horizontal plates 8 and 9 which are also handrails.

Figure 1:
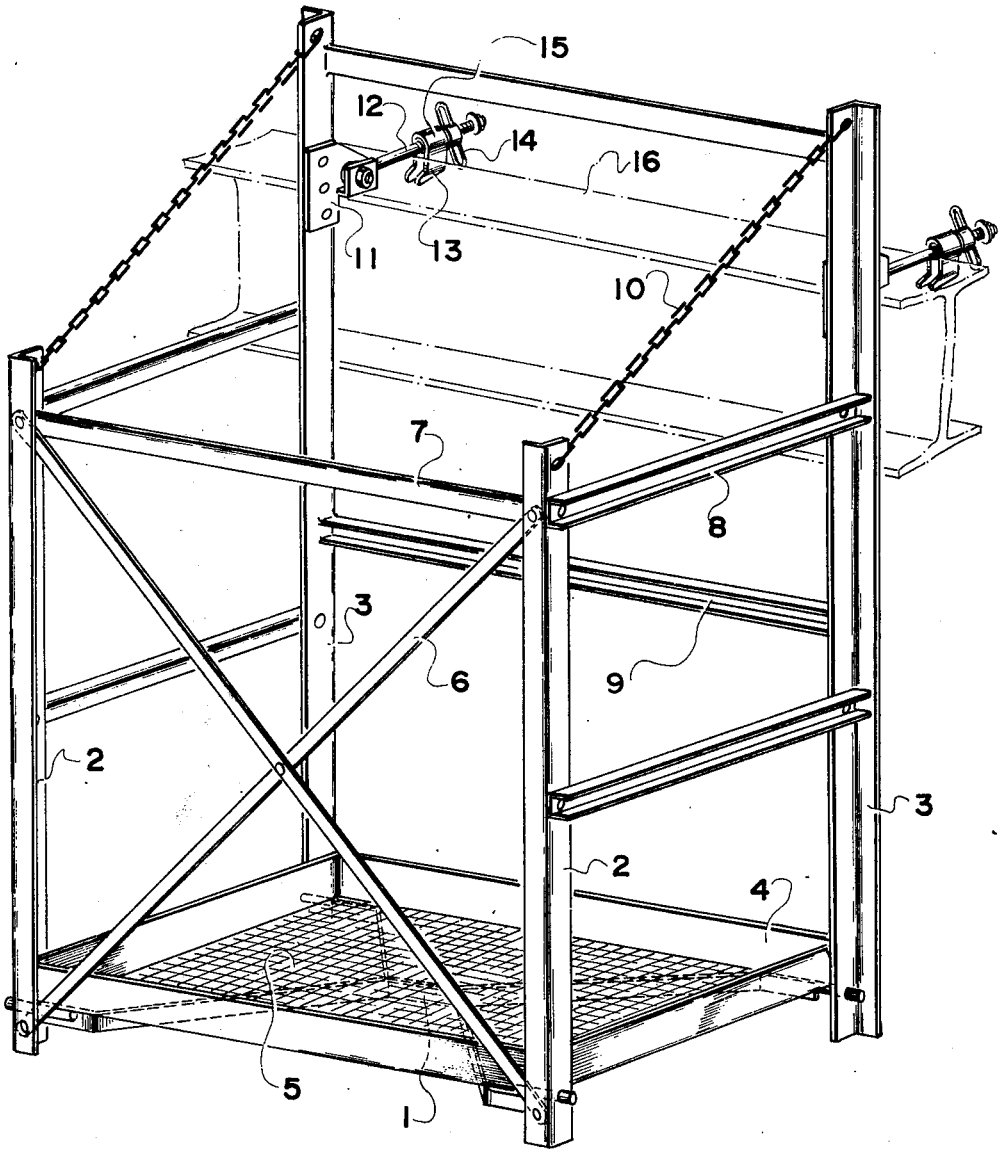
FIG. 1 is a perspective view of a scaffold device according to an embodiment of the present invention.
Figure 2:
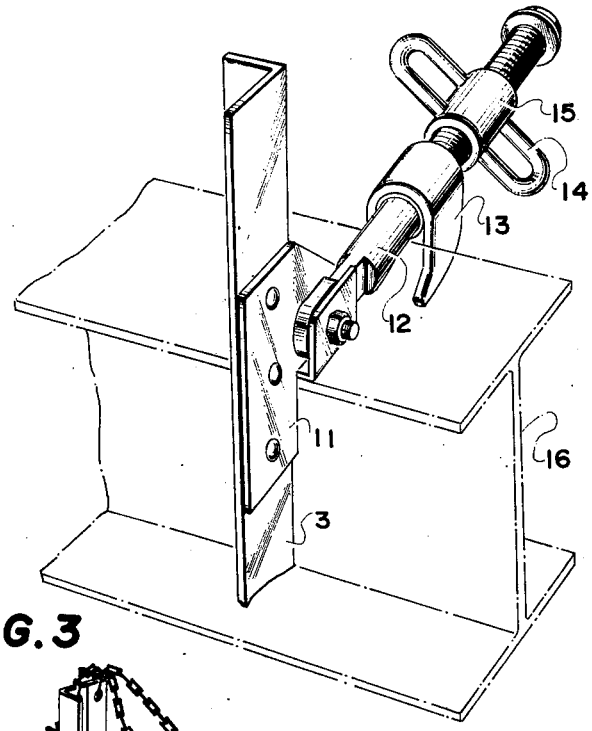
FIG. 2 is a perspective view of a pawl as engaged with an H-sectional steel.

A chain 10 is connected at one end to the upper end of each front strut 2 and at the other end to the upper end of each rear strut 3 so that, when the chains 10 are stretched, due to their own weights, the scaffold plate 1 and struts 2 may move forward to form a gondola or cage as in FIG. 1. The chains 10 may be pulled toward the rear struts 3, to collapse the cage and to cause the scaffold plate 1 and others to be folded upwardly.

The chain 10 may be replaced with an extensible rod or a connecting plate. Further, a bolt 12 extending rearward through a fitting 11 is fixed to each rear strut 3 and has a beam holder 15*a* removably loosely fitted to it. This holder15*a* consists of a tube 15 in which the bolt 12 is to be inserted, and it also has a hook-shaped jaw or pawl 13 connected to the tube and extending inwardly. Further, a nut 14 to be moved by the rotating operation of a handle portion 14a is threaded onto the bolt 12 and, when the nut 15 is moved toward the gondola, it pushes the pawl 13 into engagement with the beam 16.

The operation of the scaffold device of the present invention shall be explained in the following.

When the back surface of each rear strut 3 is pressed against the end of the H-sectioned steel beam 16 for example in a position for facilitating work by the occupant of the cage, for example, on the side of the ship for shipbuilding, the nut 14 is rotated to push in the pawl 13 toward the H-sectioned steel beam 16 so that the teeth at the tip may engage the top plate, the cage becomes fixed to the H-sectioned steel beam 16. When the scaffold is to be removed from the steel beam 16, the nut 14 may be reversely rotated to loosen the pawl 13.

When the work in the working position is finished, the gondola-like scaffold can be freely carried to another position as in a folded state and opened by loosening the chains 10.

In case the scaffold is to be housed, if the chains 10 are pullsed to the back, the front struts will be pulled upward and, as the reinforcing frame 1, scaffold plate 5 and beams 6 and 8 connected to these struts 2 are all rotatably borne, these members will be folded in parallel with the rear struts 3.

As device of the present invention can be so compactly folded as to require a small housing space and to be simple to carry. Further, it is simple to fit it into and remove from a working location.

The struts 2 and 3 and other members of the cage are advantageously made of an aluminum alloy so that, they will be very light, and each to transport and lift.

While a specific embodiment of the invention has been shown and described in detail to illustrate the application of the principles of the invention, it will be understood that the invention may be embodied otherwise without departing from such principles.

I claim:

1. An erectable and transportable scaffold cage adapted to be engaged upon and supported on a support beam, comprising a rear frame structure, means on said rear frame structure for securing said rear frame structure to the support beam, a front frame structure shorter than rear frame structure, a plurality of lateral braces arranged in vertically spaced parallel relationship and pivotally connected at their respective ends to the respective said rear frame structure and said front frame structure, a reinforcing frame pivotally connected to each side of said rear frame structure and said front frame structure adjacent the bottom ends thereof, a flexible member connected between the tops of corresponding respective ends of said rear and front frame structures and supporting said front frame structure in an erected position spaced outwardly from said rear frame structure and also in a collapsed position with said front frame juxtaposed in respect to said rear frame, in the erected position said front and rear frames structures and said side braces defining a cage therewithin, and a scaffold plate supported on said reinforcing frame and forming a scaffold floor in the erected position.

2. An erectable and transportable scaffold according to claim 1, wherein said rear frame includes a long angled strut at each side, said front frame having a short angled strut at each side of a height shorter than said rear frame, said flexible member comprising a chain connected between the top of each short strut to the top of the adjacent rear frame long strut on each side.

3. An erectable and transportable scaffold cage according to claim 1, wherein said means on said rear frame structure for securing it to a support beam comprises a bracket, a bolt pivoted to said bracket, a pawl having a cylindrical sleeve portion slidable on said bolt, and a nut threaded on said bolt for engaging against said pawl to hold it into engagement with the supporting beam.

4. An erectable and transportable scaffold cage according to claim 1, wherein said rear structure includes an angled member at each side, said front frame having a short angle member at each side of a length shorter than said long angled member and having its lower end in substantial alignment with the lower end of said long angle member in an erected position, said scaffold plate including upturned side flange extending around its periphery and positioned in said short angle members so as to engage each side of said angled member at the corner of said scaffold plate.

* * * * *